US005109546A

United States Patent [19]

Dicker

[11] Patent Number: 5,109,546

[45] Date of Patent: May 5, 1992

[54] EXERCISE SUIT WITH RESILIENT REINFORCING

[76] Inventor: Timothy P. Dicker, 11359 Dornfield Ter., Lakeview Terrace, Calif. 92353

[21] Appl. No.: 712,459

[22] Filed: Jun. 10, 1991

[51] Int. Cl.[5] ..... A41D 13/00

[52] U.S. Cl. ..... 2/70; 2/69; 2/79; 2/227; 2/239; 482/105; 482/121

[58] Field of Search ..... 2/70, 69, 79, 80, 409, 2/239, 227; 272/119

[56] References Cited

U.S. PATENT DOCUMENTS

| | | | |
|---|---|---|---|
| 4,065,814 | 1/1978 | Fox | 2/227 |
| 4,384,369 | 5/1983 | Prince | 2/79 |
| 4,698,847 | 10/1987 | Yoshihara | 2/67 |
| 4,910,802 | 3/1990 | Malloy | 272/119 |
| 4,953,856 | 9/1990 | Fox, III | 2/69 |
| 5,046,194 | 9/1991 | Alaniz et al. | 2/69 |

*Primary Examiner*—Werner H. Schroeder
*Assistant Examiner*—Gloria Hale
*Attorney, Agent, or Firm*—Cislo & Thomas

[57] ABSTRACT

An exercise suit which has a pair of stretchable pants (20) and a pull-over top (44) with a lower body reinforcing segment (38) attached, in the middle only, to the pants and a upper body reinforcing collar (54) attached, in the middle only, to the top. A leg band (42) encircle the legs (24) and the side bands (58) are affixed to the respective reinforcing collar. The leg bands (42) grip the wearer's feet creating a continuous loop from the waist to the feet. Hook and loop tape (40) allow the reinforcing segment (38) to be adjusted in tension around the wearer's waist and similarly adjusted knee pads (32) cover the knees in the pants legs (24). The resilience of the suit combined with the looped bands create a resistance to movement providing exercise to the wearer's muscles during physical activity.

22 Claims, 3 Drawing Sheets

EXERCISE SUIT WITH RESILIENT REINFORCING

TECHNICAL FIELD

The present invention relates to exercise suits in general, more particularly to form fitting pants and pullover top made of stretchable material having reinforcing segments with helically wound leg and arm resistive bands attached integrally to the suit.

BACKGROUND ART

Previously, many types of exercise suits have been used in endeavoring to provide an effective means for increasing exertion and labor to the muscles of the human body. In some cases, prior art has employed a single one piece suit using elastic bands embedded between layers of the suit to provide resistance against the movement of the wearer, particularly the arm and leg muscles. Others have added weights or restrictive elastic materials to the garment in one form or the other.

A search of the prior art did not disclose any patents that read directly on the claims of the instant invention however, the following U.S. patents were considered related:

| U.S. PAT. NO. | INVENTOR | ISSUED |
|---|---|---|
| 3,759,510 | Jackson, J. W. | 18 September 1973 |
| 4,065,814 | Fox, E. N. | 3 January 1978 |
| 4,267,607 | Tino, A. | 19 May 1981 |
| 4,384,369 | Prince, L. | 24 May 1983 |
| 4,390,999 | Lawson, et al | 5 July 1983 |
| 4,607,640 | McCusker, L. H. | 26 August 1986 |
| 4,670,913 | Morell, et al | 9 June 1987 |
| 4,890,336 | Worton, B. | 2 January 1990 |
| 4,910,802 | Malloy, E. A. | 27 March 1990 |
| 4,922,551 | Anthes, G. | 8 May 1990 |

Fox U.S. Pat. No. 4,065,814

This patent is directed to a one-piece elastic body toning suit. The suit 10 comprises a shirt section 14, a waist portion 32 and a trouser section 34. Suit 10 has an outer layer 42 and an inner layer 44 formed from cotton, nylon, polyester or acrylic, and cotton, respectively. Disposed along the front and back of suit 10 between layers 42 and 44 are two elongated vertical elastic band members 48 and 58. Band members 48, 58 terminate at the bottom of the suit leg portions 36 and 37, respectively, and have affixed to their ends triangular strap members 48 and 70, respectively. Strap members 68, 70 are adapted to receive the feet of the suit's wearer. When suit 10 is worn, band members 48, 58 are placed under tension by the downward pulling exerted by the feet of the user on strap member 68, 70, thereby creating pressure on the muscles of the body.

Tino U.S. Pat. No. 4,267,601

This patent is directed to pantyhose. The pantyhose 10 comprises a waist portion 15 and pants portion 11 and a pair of connected leg portions 12. Leg portions are provided with reinforcing bands 13 and 14 in the area of the thighs to facilitate the wearer in stretching the leg sections to the legs when the pantyhose 10 are fitted.

Lawson U.S. Pat. No. 4,390,999

This patent is direct to pantyhose with body bulge control. The pantyhose comprise a girdle portion 10, an elastic waistband 11 and a pair of hosiery leg portions 12 and 13. The upper end portion of leg portions 12 and 13 are provided with elastic or SPANDEX yarn, indicated at 14, to provide a medium amount of compressive force against a wearer's upper thighs.

McOusker U.S. Pat. No. 4,607,640.

This patent is directed to a athletic/industrial brassiere with protective inserts. The brassiere 11 comprises a stretchable band 12 that encircles the thoracic cage, hook end elements 13 attached to the ends of band 12, and right and left breast portions 14R and 14L, respectively. Breast portions 14R and 14L comprise outer and inner fabric layers 17A and 17B, respectively. Fabric layers 17A, 17B are stitched together in a manner that defines a thin pocket on each breast portion. Plastic inserts 21R and 21L made from high density polyethylene are inserted into the pockets to protect the user's thoracic cage from forces of impact.

Malloy U.S. Pat. No. 4,910,802

This patent is directed to an exercise suit. The suit 10 is made of a stretchable fabric such as nylon and comprises a unitary construction including a torso portion 11 and pants 12 joined by a waist portion. Torso section 11 and pants 12 include a series of conduits for elastic bands. Referring to FIG. 1, the sleeves include upper and lower elastic bands 18*a* and 18*b*, 19*a* and 19*b*, 20*a* and 20*b*, and 21*a* and 21*b*. Lower and upper elastic bands are secured together by serrated toothbuckles 29. The elastic bands are adjustable to provide a desired pre-load or tension determining the level of exercise of a wearer of suit 10. The elastic bands on the pants 12 serve the same function as those on the torso section. However, elastic band 24, located on the waist portion, merely maintains the suit 10 at a predetermined orientation relative to the user.

For background purposes and as indicative of the art to which the invention relates, reference may be made to the remaining cited patents issued to Jackson, Price, Morell et al, Worton and Anthes,

DISCLOSURE OF THE INVENTION

Many attempts have been made in the prior art to incorporate elastic material of one kind or the other in order to offer resistance to the human body when kinetically acted upon. The use of a two-piece suit of a stretchable material with specific adjustable elastic materials has not been considered, particularly with sewn-in resistant segments or panels and resistive bands so arranged as to provide resistance to the muscles of the body during movements such as walking or running. It is therefore a primary object of the invention to provide a stretchable suit with elastic reinforcing segments and bands that are adjustable to increase or decrease the amount of resistance during various activities.

These elastic reinforcements helically wind around the lower limbs of the body to provide the greatest amount of resistance force in an anatomically correct manner, thus exercising a greater portion of the muscles while walking or running.

An important object of the invention is that the suit allows the user to tone and build muscle mass while conducting a primary exercise. Therefore the time used in exercising is maximized in the development process of physical activity.

Another object of the invention is directed to increasing lymph flow and vascularging in a controlled manner. As the elastic bands, reinforcing segments and collar are specifically located, such that a balance may be achieved in accomplishing this desirable muscular growth amplification.

Still another object of the invention is a minimizing of low back injuries while exercising. As the suit is elastic in nature initially, and the stretchable reinforcements are positioned in areas complimentary to the natural muscular orientation, thus the strain on the lower back is basically controlled. While it may be impossible to eliminate completely strains to the muscles in exercising due to the vast differences in strength and individual endurance, the invention has a controlling influence and has in its inception taken this object into consideration.

Yet another object of the invention allows adjustment in the amount of resistance to the legs. The segment encircling the waist and attaching the ends of the leg bands may be tightened or loosened, by disconnecting and reconnecting each side individually using hook and loop tape better known by its tradename VELCRO. This adjustment pre-stresses the lower body segment around the waist and over the abdomen and as the attachment to the pants is only in the center, the resistive force is transmitted directly to the leg bands allowing a regulated resistive balance as selected by the user.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
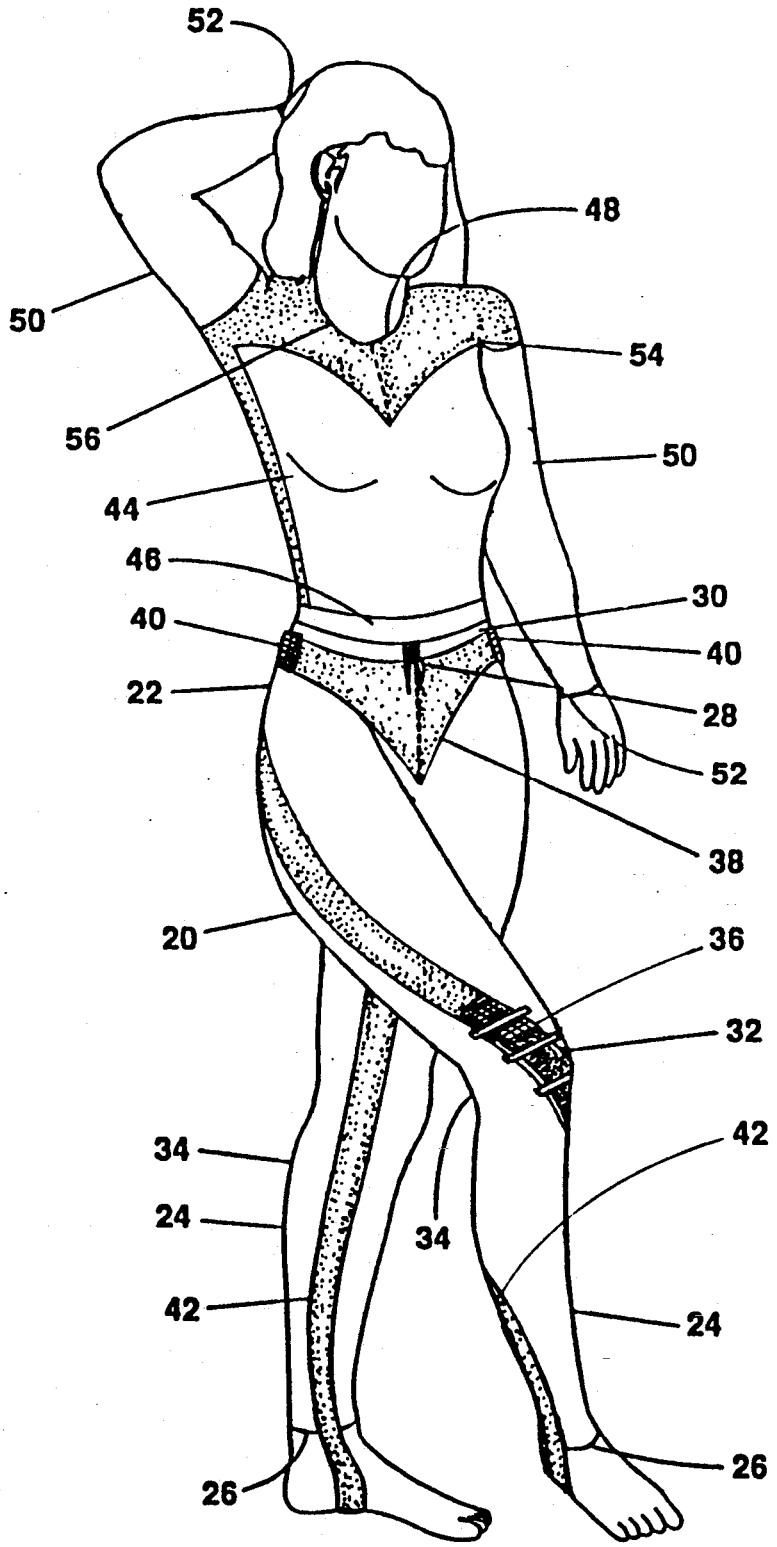
FIG. 1 is a front view of person wearing the exercise suit.
Figure 2:
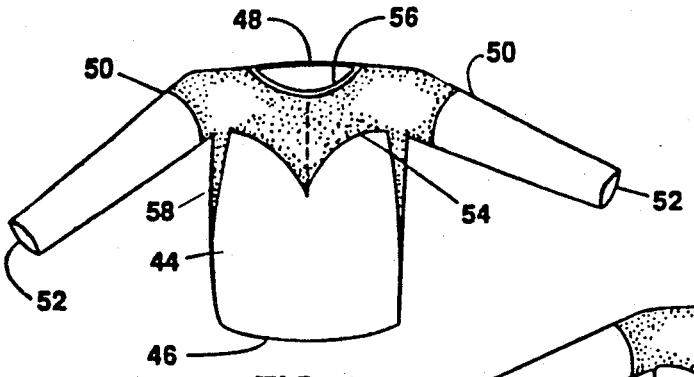
FIG. 2 is a front view of the pull-over top by itself.
Figure 3:
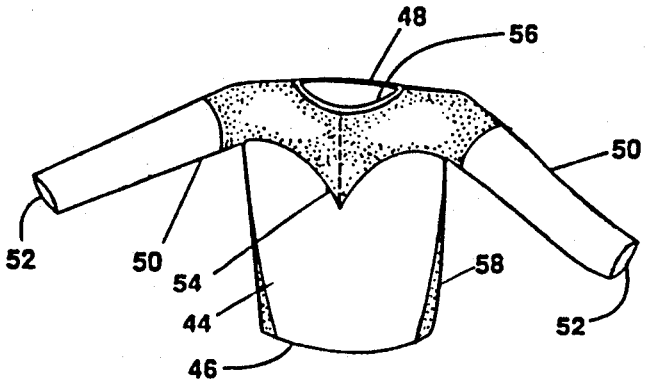
FIG. 3 is a rear view of the pull-over top by itself.
Figure 4:
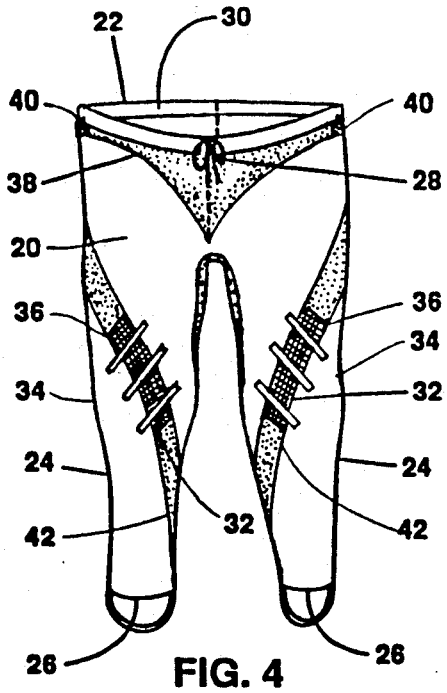
FIG. 4 is a front view of the pants.

The best mode for carrying out the invention is presented in terms of a preferred embodiment. The preferred embodiment, as shown in FIGS. 1 through 9 is comprised of a pair of stretchable form fitting pants 20 complete with an open waist, a pair of legs 24 and an ankle opening 26 in each leg. The pants 20 are made to fit tightly over the body and include a drawstring 28 adjacent to and parallel with the waist 22. The drawstring 28 is disposed within a overlapped encasement 30 allowing the wearer to pull each end of the drawstring 28 tight and tie it together in a bow. While the pants 20 fit tightly, the drawstring 28 simply assures that the waist 22 does not slip down out of place during physical exercise movement of the wearer.

The pants 20 are preferably made of a synthetic fiber material of a polymer that contains at least 85 percent polyurethane. This material is known commonly as SPANDEX and is elastic in nature allowing stretching with a memory allowing a return to its normal size. Further, the material may be sewn together by stitching with thread permitting the pants 20 to be made in any size and shape as with conventional non-stretching fabric.

Figure 6:
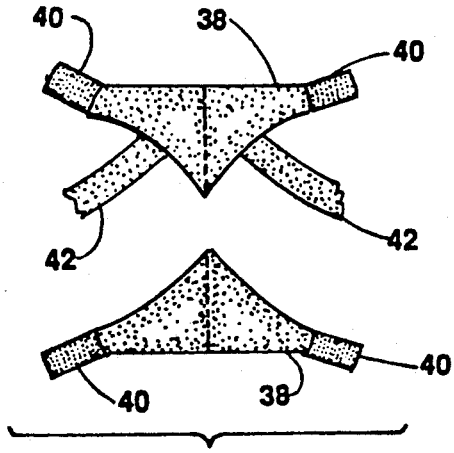
FIG. 6 is a plan view of the lower body reinforcing segments laid flat with only a small portion of the leg bands illustrated. This segment is completely removed from the invention for clarity.

A pair of resilient lower body reinforcing segments 38 are juxtapositioned on the pants 20 across the front and back and between the legs 24. These reinforcing segments 38 are in a triangular shape with angular corners. FIG. 6 illustrates the reinforcing segments laid flat completely removed from the pants 20. The corners of the reinforcing segments contain a length of hook and loop tape 40 commonly known by its registrated trademark VELCRO 32 except the shape is different. The loop section is preferably attached, by sewing, to the rear corners of the pants and the hook section is sewn directly beneath the front side of the pants 20. The tape 40 may be in any configuration however, the preferred embodiment employs a rectangular shape on the front and back. This shape allows easy access to the corners when adjustment is required and sufficient area is available to make a secure attachment.

The reinforcing segments 38 are attached to the pants 20 only on the center, or middle, from the top to bottom preferably with sweing. This attachment is important as it transmits the resistive force to the center of the wearer's body parallel to the backbone and equalizes the linear tension eliminating unbalanced forces.

As the reinforcing segments 38 are attached to the pants 20 in the center and the corners are connected to each other, the segments remain in place even when the pants are removed.

Figure 5:
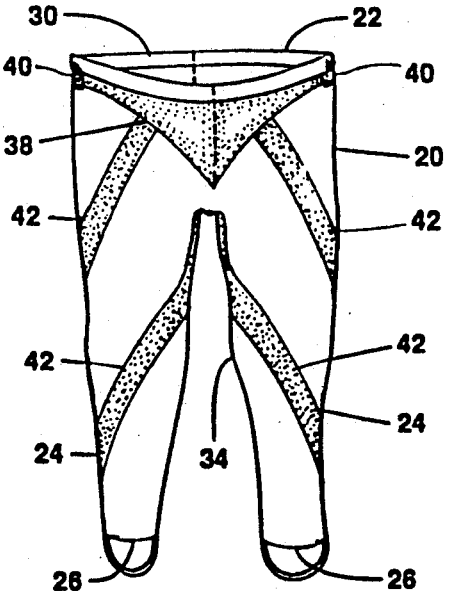
FIG. 5 is a rear view of the pants.
Figure 7:
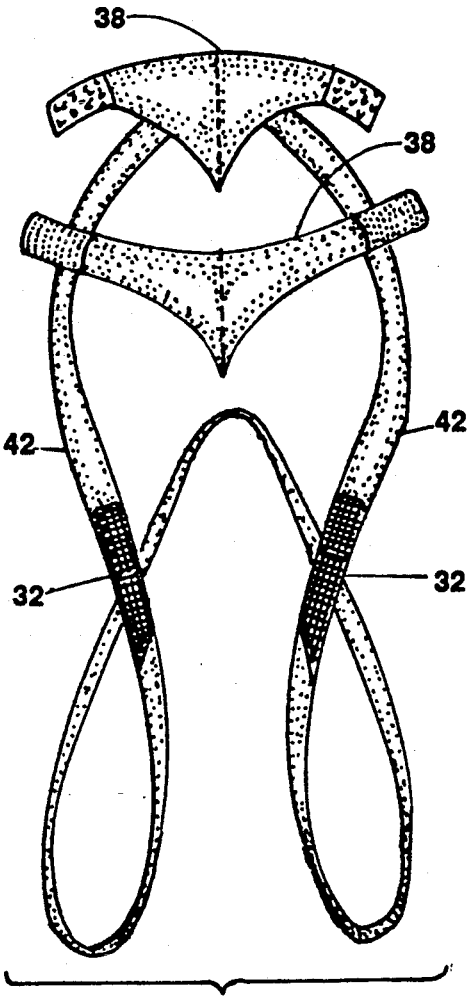
FIG. 7 is a front isometric view of the lower body segment and the leg band completely removed from the pants and yet oriented as they would be worn.
Figure 8:
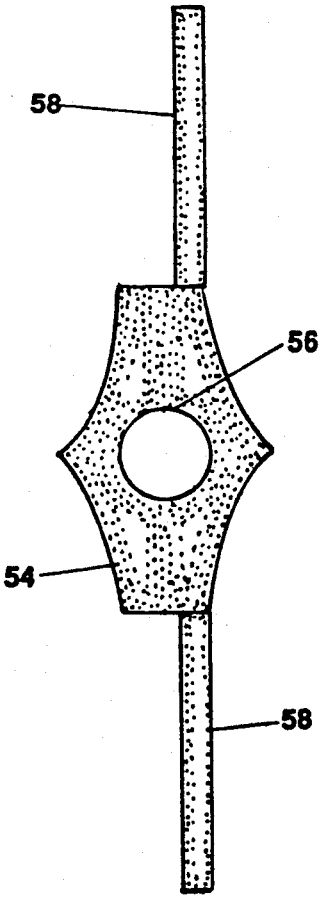
FIG. 8 is a plan view of the upper body reinforcing collar band including side bands laid flat depicting the attachment of the bands and the dashed lines representing the stitching that attaches the collar band to the pull-over top.

An elongatable resistive leg band 42 spirally encircles each pant leg 24 and is linearly attached to the pants. The ends are permanently affixed to the back reinforcing segment 38 as shown in FIGS. 5 and 6. This disposition provides a loop that continues around each side of the ankle openings 26 creating a spirally wound resistance band that starts from the back of the reinforcing segment 38 around the pant legs 24 over the knee through the crotch in a looping fashion contiguously parallel with the point of origin. It may be plainly seen that the leg band 42 being a continuous loop provides a controlled amount of resistance in an anatomically accurate manner. FIG. 7 depicts the band 42 attached to the reinforcing segment 38 without the pants 20 for clarity illustrating the loop principle.

The band 24 is in one piece, however at each knee, a number of pad loops 33 attached to the pants 20 over the knee area retain the pad 32 in place and hold the hook and loop tape tightly together for maximum tensional strength.

Figure 9:
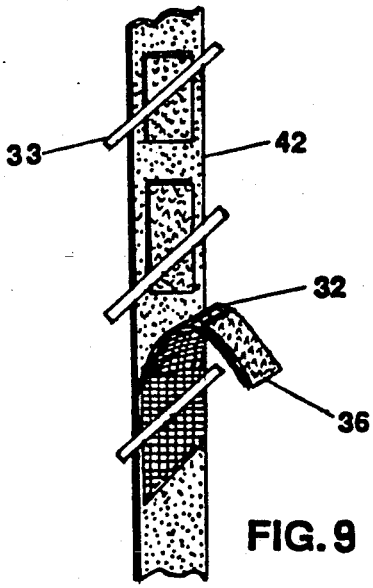
FIG. 9 is a fragmentary view of the leg band with the knee pad turned down to illustrate its adjustability.

A resilient stretchable reinforcing knee pad 32 is fastened below the knee area 34 of the pants 20 allowing an adjustable bending resistance to wearer's knee. The pads 32 are adjustable in length permitting altering the amount of resistance as they are permanently attached to the lower portion by sewing with thread while the upper portion employs hook and loop tape 36 the same as used in the corners of the reinforcing segments 40. The loop tape is sewn above the knees 34 onto the pants 20 and the hook tape is attached to the inside of the knee pad 32. This arrangement allows the pad to be pulled taut and fastened to the knee or loosely connected permitting adjustment to any desired resistance. FIG. 9 depicts the pad 32 disconnected on one corner illustrating the adjustable nature of the attachment method.

A stretchable form fitting pull-over top 44 completes the basic suit covering the top half of the wearer's body. The top 44 has an open waist 46 and an open neck 48 also a pair of sleeves 50 with wrist openings 52. The pull-over top 44 is illustrated in FIG. 1 on a person and FIGS. 2 and 3 by itself.

A resilient upper body reinforcing collar 54 is attached in the center only of the pull-over top 44 in a similar manner as the lower body reinforcing segment 38. This collar 54 is in diamond shape with truncated ends and has a circular opening 56 in the center for the wearer's head. The collar 54 is arranged such that the ends of the truncated diamond shape are over the wearer's shoulders forming a short sleeve and are attached in the center of the front and back creating a resilient foundation.

A pair of elongatable resistive side bands 58 are attached at the upper end to the collar 54. The lower end is attached likewise to the waist opening 46 providing a resistive restraint upon the wearer whenever the body is moved in any direction. The wearer's back and shoulders are jointly restrained by the collar 54 assisted by the side bands 58.

The top 44 is made of the same material as the pants 20 and the leg and side bands 42 and 58 are made of latex rubber strips having a width from 4 inches (10.2 cm) to 6 inches (15.2 cm) wide. While any latex rubber strips may be used, it has been found that the material known by its tradename THERA-BAND has proven optimum in the application. The reinforcing segment and collar 38 and 54 preferably are made of heavy 75 percent elastic or so called SUPER-SPANDEX.

In use, the wearer pulls the pants 20 and top 44 on much like conventional exercise suits. The waist drawstring 28 is tied and the adjustment is made on the sides over the hips detaching and reattaching the hook and loop tape 40 creating the desired resistance to the reinforcing segment 38 and leg bands 42. The knee pads 32 are likewise adjusted and the person conducts the desired exercise readjusting when desired.

While the invention has been described in complete detail and pictorially shown in the accompanying drawings, it is not to be limited to such details since many changes and modifications may be made in the invention without departing from the spirit and the scope thereof. Hence, it is described to cover any and all modifications and forms which may come within the language and scope of the appended claims.

I claim:

1. An exercise suit with resilient reinforcement for increasing resistance to a wearer's muscles comprising:

a) a pair of stretchable form fitting pants having an open waist and a pair of legs each containing an ankle opening therein, b) a pair of resilient lower body reinforcing segments having a front segment and a back segment both in a triangular shape with angular corners and juxtapositioned on the pants on each side of the waist and each fastened to the pants on a center most portion parallel with a wearer's backbone, said segments having adustable fastening means on two corners permitting the wearer to increase or decrease tension created by the resiliency of the segment, c) an elongatable resistive leg band spirally encircling each pant leg and affixed thereunto, said band attached jointly at both ends to the back lower body reinforcing segment crossing the wearer's knee and looped over each wearer's foot beyond the ankle opening forming a resistive constraint upon the wearer's lower body and leg movement for muscular toning and exercise, d) a stretchable form fitting pull-over top having an open waist, a neck opening, sides and a pair of sleeves each containing a wrist opening on an end thereof, e) a resilient upper body reinforcing collar in a diamond shape with truncated ends having a circular opening in the center for the user's head, juxtapositioned on the pull-over top around the neck opening and attachably fastened on the center most portion parallel with a wearer's backbone, and f) an elongatable resistive side band having a first end and a second end and affixed on each side, each band attached on the first end to the collar, along the side terminating and on the second end at the waist opening forming a resistive constraint upon the wearer's upper body movement for muscular toning and exercise.

2. The exercise suit as recited in claim 1 wherein the stretchable form fitting pants further comprise a drawstring adjacent to and parallel with the open waist disposed within an overlapped encasement permitting a wearer to draw the string tight to hold the pants in a comfortable position.

3. The exercise suit as recited in claim 1 wherein said stretchable form fitting pants and pull-over top comprise a synthetic fiber meterial of a polymer containing at least 85 percent polyurethane.

4. The exercise suit as recited in claim 1 wherein said lower body reinforcing segment adjustable fastening means comprises hook and loop tape attached to the corners thereof with the loop tape affixed to one corner and the hook tape conected overlappingly to the other such that the wearer may pull the hook tape taut and attach it upon the loop tape with a desired amount of resistive tension.

5. The exercise suit as recited in claim 1 wherein said leg and side bands further comprise latex rubber strips attached to the pants and top having a pre-determined amount of stretchable resiliency.

6. The exercise suit as recited in claim 5 wherein the latex rubber strips are from 4 inches (10.2 cm) to 6 inches (15.2 cm) wide.

7. The exercise suit as recited in claim 1 further comprising a pair of resilient, stretchable reinforcing knee pads having a top and a bottom with the bottom permanently attached to the pants below each knee and the top having adjustable attaching means above each knee permitting alteration of the position of the pads relative to the wearer's knee increasing or decreasing resistive tension thereupon.

8. The exercise suit as recited in claim 7 wherein said knee pad adjustable attaching means further comprises hook and loop tape with the loop tape attached to the knees of the pants and the hook tape attached to the knee pads.

9. An exercise suit with resilient reinforcement for increasing resistance to a wearer's muscles comprising:

a) a pair of stretchable form fitting pants having an open waist and a pair of legs each containing an ankle opening therein, also a drawstring adjacent to and parallel with the open waist disposed within an overlapped encasement permitting a wearer to draw the string tight to hold the pants in a comfortable position, b) a pair of resilient lower body reinforcing segments having a front segment and a rear segment both in a triangular shape with angular corners juxtapositioned on the pants on each side of the waist each fastened to the pants on a center most portion parallel with a wearer's backbone, said segment having adjustable fastening means on two corners permitting the wearer to increase or decrease tension created by the resiliency of the segment, c) an elongatable resistive leg band spirally encircling each pant leg and affixed there 175 jointly at both ends to the back lower body reinforcing segment crossing over the wearer's knee and looped over each wearer's foot beyond the ankle opening forming a resistive constraint upon the wearer's lower body and leg movement for muscular toning and exercise, d) a stretchable form fitting pull-over top having an open waist, a neck opening, sides and a pair of sleeves each containing an wrist opening on an end thereof, e) a resilient upper body reinforcing collar in a diamond shape with truncated ends having a circular opening in the center for the users head, juxtapositioned on the pull-over top around the neck opening attachably fastened on the center most portion parallel with a wearer's backbone, f) an elongatable resistive side band having a first end and a second end affixed on each side, each band attached on the first end to the collar along the side terminating on the second end at the waist opening forming a resistive constraint upon the wearer's upper body movement for muscular toning and excerise, and g) a pair of resilient, stretchable reinforcing knee pads having a top and a bottom with the bottom permanently attached to the pants below each knee and the top having hook and loop tape with the loop tape attached to the knee pads permitting alteration of the position of the pads relative to the wearer's knee increasing or decreasing resistive tension thereupon.

10. An exercise suit with resilient reinforcement for increasing resistance to wearer's muscles comprising:

a) a pair of stretchable form fitting pants having an open waist and a pair of legs each containing an ankle opening therein, also a drawstring adjacent to and parallel with the open waist disposed within an overlapped encasement permitting a wearer to draw the string tight to hold the pants in a comfortable position, b) a pair of resilient lower body reinforcing segments in a triangular shape with angular corners and juxtapositioned on the pants on each side of the waist and each fastened to the pants on a center most portion parallel with a wearer's backbone, said segment having adjustable fastening means on two corners permitting the wearer to increase or decrease tension created by the resiliency of the segment, and c) an elongatable resistive leg band spirally encircling each pant leg and affixed thereunto, said band attached jointly at both ends to the back lower body reinforcing segment crossing over the wearer's knee and looped over each wearer's foot beyond the ankle opening forming a resistive constraint upon the wearer's lower body and leg movement for muscular toning and exercise.

11. The exerxise suit as recited in claim 10 wherein the stretchable form fitting pants further comprise a drawstring adjacent to and parallel with the open waist disposed within an overlapped encasement permitting a wearer to draw the string tight to hold the pants in a comfortable position.

12. The exercise suit as recited in claim 10 wherein said stretchable form fitting pants comprise a synthetic fiber material of a polymer containing at least 85 percent polyurethane.

13. The exercise suit as recited in claim 10 wherein said lower body reinforcing segment adjustable fastening means comprises hook and loop tape attached to the corners thereof with the loop tape affixed to one corner and the hook tape connected overlappingly to the other such that the wearer may pull the hook tape taut and attach it upon the loop tape with a desired amount of resistive tension.

14. The exercise suit as recited in claim 10 wherein said leg bands further comprise latex rubber strips attached to the pants having a pre-determined amount of stretchable resiliency.

15. The exercise suit as recited in claim 14 wherein the latex rubber strips are from 4 inches (10.2 cm) to 6 inches (15.2 cm) wide.

16. The exercise suit as recited in claim 10 further comprising a pair of resilient, stretchable reinforcing knee pads having a top and a bottom with the bottom permanently attached to the pants below each knee and the top having adjustable attaching means above each knee permitting alteration of the position of the pads relative to the wearer's knee increasing or decreasing resistive tension thereupon.

17. The exercise suit as recited in claim 16 wherein said knee pad adjustable attaching means further comprises hook and loop tape with the loop tape attached to the knees of the pants and the hook tape attached to the knee pads.

18. An exercise suit with resilient reinforcement for increasing resistance to a wearer's muscles comprising:

a) a stretchable form fitting pull-over top having an open waist, a neck opening, sides and a pair of sleeves each containing a wrist opening on an end thereof, b) a resilient upper body reinforcing collar in a diamond shape with truncated ends having a circular opening in the center for the user's head, juxtapositioned on the pull-over top around the neck opening attachably fastened on the center most portion parallel with a wearer's backbone, and c) an elongatable resistive side band having a first end and a second end affixed on each side, each band attached on the first end to the collar along the side and terminating on the second end at the waist opening forming a resistive constraint upon the wearer's upper body and movement for muscular toning and exercise.

19. The exercise suit as recited in claim 18 wherein said stretchable form fitting pull-over top comprises a synthetic fiber material of a polymer containing at least 85 percent polyurethane.

20. The exercise suit as recited in claim 18 wherein said lower body reinforcing segment adjustable fastening means comprises hook and loop tape attached to the corners thereof with the loop tape affixed to one corner and the hook tape connected overlappingly to the other such that the wearer may pull the hook tape taut and attach it upon the loop tape with a desired amount of resistive tension.

21. The exercise suit as recited in claim 18 wherein said side bands further comprise latex rubber strips attached to the pants and top having a pre-determined amount of stretchable resiliency.

22. The exercise suit as recited in claim 21 wherein the latex rubber strips are from 4 inches (10.2 cm) to 6 inches (15.2 cm) wide.

* * * * *